United States Patent [19]

Mattes

[11] Patent Number: 4,766,610

[45] Date of Patent: Aug. 30, 1988

[54] REPLACEABLE CUSHION LINER FOR MILITARY HEADGEAR

[75] Inventor: Paul B. Mattes, Garland, Tex.

[73] Assignee: Varo, Inc., Garland, Tex.

[21] Appl. No.: 6,734

[22] Filed: Jan. 22, 1987

[51] Int. Cl.[4] ..... A42B 3/00

[52] U.S. Cl. ..... 2/6; 2/414; 427/180; 428/919; 350/248

[58] Field of Search ..... 2/414, 412, 420, 416, 2/6; 427/180; 350/547, 548, 549, 248, 249; 428/919

[56] References Cited

U.S. PATENT DOCUMENTS

| | | | |
|---|---|---|---|
| 2,936,814 | 5/1960 | Yakubik | 427/180 X |
| 3,166,761 | 1/1965 | Strohm | 2/427 |
| 3,577,562 | 5/1971 | Holt | 2/414 |
| 3,820,163 | 6/1974 | Rappleyea | 2/428 |
| 3,916,446 | 11/1975 | Gooding | 2/421 |
| 4,282,610 | 8/1981 | Steigerwald et al. | 2/414 |
| 4,443,891 | 4/1984 | Blomgren et al. | 2/414 |
| 4,446,576 | 5/1984 | Hisataka | 2/425 |
| 4,465,731 | 8/1984 | Pusch et al. | 428/919 X |
| 4,572,844 | 2/1986 | Inoue et al. | 427/180 |

*Primary Examiner*—Peter Nerbun

*Attorney, Agent, or Firm*—Jerry W. Mills; Roger N. Chauza

[57] ABSTRACT

A headgear cushion (18) having a closed-cell foam core coated with a non-allergenic vinyl/nitrile composition. A powdered carbon is mixed with the vinyl/nitrile composition to provide a dark color. Pressure responsive material (28, 30) is adhered to the coated foam core (20, 26) and made removably attachable to a headgear (10).

13 Claims, 1 Drawing Sheet

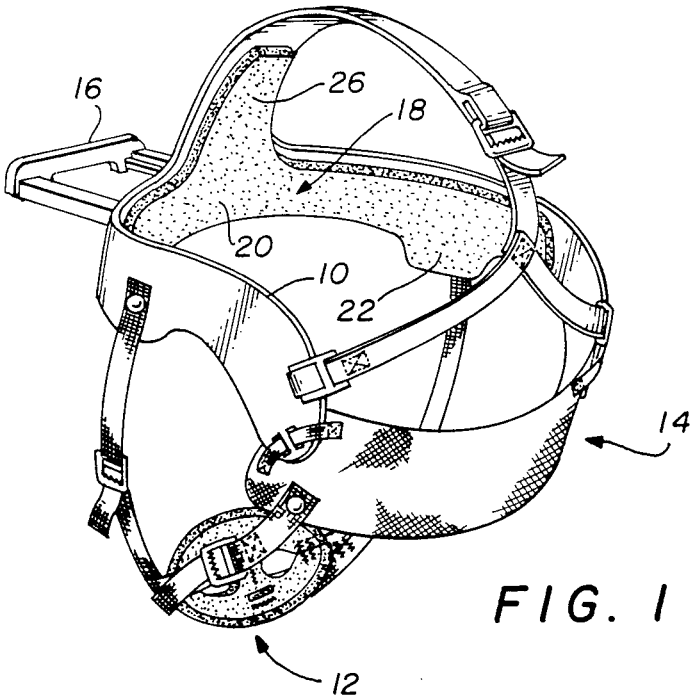
FIG. 1
FIG. 2
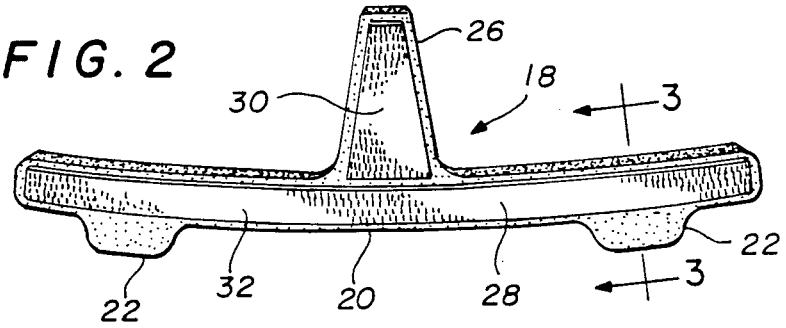
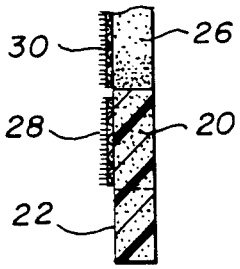
FIG. 3

REPLACEABLE CUSHION LINER FOR MILITARY HEADGEAR

RELATED APPLICATION

"Chin Cup for Use With Headgear", by Paul B. Mattes, Ser. No. 006,023, now U.S. Pat. No. 4,741,054 issued May 3, 1988, filed concurrently herewith.

TECHNICAL FIELD OF THE INVENTION

The present invention relates in general to helmets and headgear equipment, and more particularly relates to compositions and techniques for cushioning such helmets and headgear equipment.

BACKGROUND OF THE INVENTION

Helmets and headgear intended for wear during extended periods of time generally incorporate some type of cushioning on the inner surface thereof to reduce pressure and stress on the head of the wearer. A padding or cushion interface between the helmet and wearer distributes the weight, and thus the pressure of the helmet or headgear and any other equipment attached thereto. Hence, with reduced areas of concentrated pressure, the wearer is less likely to encounter headaches, stress and fatigue.

One approach for cushioning a helmet to a wearer's head is to attach a leather-covered foam at various areas within the helmet or headgear where contact to the wearer's head will not affect nerves or restrict the flow of blood. Plural spaced apart cushion pads are generally provided for this purpose, as well as to promote air circulation between the headgear and the wearer's head.

In military applications, the leather covering of the foam pad is required to be of a non-allergenic type, and specifically comprises the processed hide of a certain hairless sheep which can be found in foreign countries. Because of the chemicals required to process or tan this special type of leather, such processed leather can only be purchased abroad, and is in many instances in limited supply. The high cost of the noted leather material is apparent.

Yet other types of headgear cushioning techniques utilize a webbing or cantilever strap network anchored to the headgear so that the webbing rests on the crown of the wearer's head with the helmet spaced from the wearer's head. This approach is labor intensive, in that various straps need to be cut to various sizes and sewn together, then fastened to the helmet. Another shortcoming of this approach, as well as those described above, is that to accommodate a number of head sizes, a corresponding number of helmets or headgear types is required.

More recently, a vinyl/nitrile coated foam cushion has been developed for use with football helmets and the like. The padding is sewn or otherwise fixed to the interior surface of the helmet. The vinyl/nitrile is obtainable locally and is also a non-allergenic composition. The cushioning pad used in sports equipment includes several inherent disadvantages when utilized with military headgear.

From the foregoing, it can be seen that a need exists for a new type of headgear cushion which is inexpensive, easy to manufacture, non-allergenic, and replaceable. An associated need exists for a variety of replaceable cushions useable in a single headgear type to accommodate varying head sizes of wearers.

SUMMARY OF THE INVENTION

In accordance with the present invention, the disclosed headgear cushion reduces or substantially eliminates the disadvantages and shortcomings associated with the prior art techniques and devices. According to the headgear cushion of the invention, a vinyl/nitrile composition coated foam rubber is made removably attachable to a headgear. A foam core comprises a high density closed-cell type which, when coated with the vinyl/nitrile composition provides a smooth non-allergenic surface. The foam core is dip-coated in the composition so that all surfaces thereof are covered to prevent deterioration of the foam core.

A pressure responsive attachment material is bonded to the back surface of the composition-covered foam. A corresponding size mating pressure responsive material is fixed to desired locations on the inside surface of the headgear so that the foam cushion can be attached thereto. The foam cushions and pressure responsive attachment material can be formed in various shapes, such as strips or patches, and pressed into the inside surface of the headgear and removably attached thereto.

In fabricating the composition-covered foam cushions, foam material of different thicknesses are stamped from a sheet to provide the desired shapes to fit specific headgear areas. The stamped parts of the foam are then dipped into a liquid vinyl/nitrile and allowed to cure. For military use, the vinyl/nitrile mixture may be colored with a dark pigment to reduce the light reflection therefrom. In the preferred form of the invention, carbon is utilized to fabricate a black vinyl/nitrile foam cushion. Precut pieces of pressure responsive material, such as Velcro, are then adhered to the backside of the composition-covered foam. After the adhesive has set, the cushion is ready to be applied to a headgear. The cushions constructed of thin foam cores accommodate larger head sizes, while thicker foam cores are removably fixed within a headgear to accommodate correspondingly smaller head sizes.

BRIEF DESCRIPTION OF THE DRAWINGS

Further features and advantages will become more apparent from the following and more particular description of the preferred embodiment of the invention, as illustrated in the accompanying drawings in which like reference characters generally refer to the same parts throughout the views, and in which:

FIG. 1 is an isometric top rear view of a head gear, illustrating the application of the foam cushioning thereto;

FIG. 2 is an elevational back view of a foam cushion with pressure responsive attachment means bonded thereto; and FIG. 3 is a sectional view of the foam cushion, taken along line 3—3 of FIG. 2.

DETAILED DESCRIPTION OF THE INVENTION

Referring first to FIG. 1 of the drawing, there is shown an application in which the invention may be advantageously practiced. While the cushioning pads of the invention are disclosed in connection with a headgear adapted for use with night vision equipment, the invention is not limited to such applications. Indeed, the invention may find a wide variety of applications in non-military type headgear, such as in law enforcement or sports.

Shown in FIG. 1 is a generally flexible headgear 10 with a strap and chin cup arrangement 12 for securing the headgear 10 vertically about the user's head. Another strap arrangement 14 is attached to the headgear 10 for securing the headgear 10 laterally about the user's head. In the illustrated headgear 10, a cantilever support 16 is fixed to the headgear 10 for supporting night vision equipment (not shown) thereto.

Removably fixed to the interior of the headgear 10 is a foam cushion pad 18 generally shaped according to the framework of the headgear 10. With regard to the headgear 10 shown, the cushion 18 includes a brow pad strip 20 which engages the wearer's head laterally about the forehead area. The brow pad strip 20 includes short extensions 22 which extend downwardly somewhat in the vicinity of the wearer's temples.

The short extensions 22 provide an interface cushion for pressure relief on those types of headgear in which a strap end of the chin cup arrangement 12 includes a snap for snap fitting to the frame of the headgear 10. Other portions of the headgear may also be outfitted with removable cushion pads. Additional cushioned areas may be provided for distributing the weight of the headgear 10, and any attached equipment, over the surface of the wearer's head.

The cushion 18 further includes a vertical strip 26, integral with the brow pad strip 20. The vertical strip 26 is directed upwardly for engaging the foremost crown portion of the wearer's head.

The headgear cushion 18 is shown in more detail in FIG. 2. The back surface of the cushion 18 is covered with a pressure responsive material, such as Velcro. A lateral strip 28 of pressure responsive material is adhered, or otherwise fastened, to the brow pad portion 20 of the cushion. The pressure responsive material 28 extends substantially the entire length of the brow pad strip 20. A vertical strip of pressure responsive material 30 is adhered in a similar manner to the crown strip 26 of the cushion 18. The pressure responsive material is shown characterized by a plurality of densely arranged hooks 32. A corresponding pattern of pressure responsive material of the mating type (loops) would be adhered to the interior surface of the headgear 10 at the location in which it is desired to fix the cushion 18.

A cross-sectional view of the headgear cushion 18 shown in FIG. 3 illustrates the pressure responsive material 28 adhered to the brow pad portion 20, without covering the temple extensions 22. The pressure responsive strip 30 substantially covers the vertical crown strip part 26. Patterns of pressure responsive material, other than those shown can be used to adequately fasten the cushion 18 to the frame of the headgear 10. Also, many other cushion shapes can be utilized for adapting to the particular shape and construction of the headgear types.

In fabricating the headgear cushion 18 of the invention, it is preferable to utilize a closed-cell high density foam rubber. A density in the range of 2.0 to 6.0 pounds per cubic foot is suitable for headgear of average weights. An even higher density foam can be used to provide adequate cushioning for heavier types of headgear. Conventionally available foam rubber comprises a suitable material for providing the cushioning agent or core of the headgear cushion 18. Sheets of stock foam material may be used for stamping the various shapes of cushion strips or pads required for different types of headgear. Moreover, and as referred to above, foam sheets of various thicknesses can be utilized for providing thin headgear cushions and thick headgear cushions replaceable within a single type of headgear. This allows a single headgear to accommodate persons with different sized heads. Foam thicknesses of $\frac{1}{8}$ to $\frac{1}{2}$ inch have been found to provide adequate thicknesses to accommodate the normal range of head sizes.

After stamping the predetermined shaped cushion or pad cores from the foam sheets, the foam cores are dipped into a liquid vinyl/nitrile composition. This composition is highly advantageous as it is non-allergenic and locally available. Moreover, in its cured state the vinyl/nitrile remains pliable to allow the deformation of the underlying foam for conforming to irregularities and the contours of the wearer's head. The vinyl/nitrile composition can be prepared per military specifications ASTM D-1667-81, and obtained from ADCO, Box 489, Cookville, Tennessee.

A color pigment can be added to the vinyl/nitrile composition to provide desired colors of the finished headgear cushion 18. For military use, dark colored equipment is preferable to reduce light reflections, and thus the possibility of identification by an adversary. In the preferred form of the invention, a finely powdered carbon can be added to the vinyl/nitrile composition to color the headgear cushion to a black color.

After the vinyl/nitrile composition has cured, the pressure responsive material 28 and 30 can be adhered thereto by a conventional adhesive or cement, preferably one which is resistant to moisture and oils.

The combination high density foam, dark colored headgear cushion presents a decided advantage over the cushions heretofore known and identified above. Particularly, the high density foam is characterized by a reduced porosity so that when coated with the vinyl/nitrile, a smooth surface results. This prevents a buildup of skin oils on the headgear cushion and a corresponding accumulation of dirt. In addition, with a smooth surface, the headgear cushion is easy to clean. The dark color in combination with the smooth exterior surface of the headgear cushion prevents light reflections and thus easy identification thereof. This is especially important in military environments when the personnel may remove the headgear to rest, or for other purposes.

From the foregoing, a headgear cushion has been disclosed, and provides decided advantages over the headgear equipment heretofore known. The headgear cushion of the invention is removably attachable to a headgear type, and when provided with different thickness cushions, a single headgear type can accommodate numerous head sizes. Equally as important, the headgear cushion of the invention is constructed of a high density foam, dip-coated with a non-allergenic composition of vinyl/nitrile. The noted composition seals the outer pores of the foam and provides a durable, smooth, slick surface. Moreover, the vinyl/nitrile composition can be easily cleaned, is inexpensive, and can be colored with a pigment.

While the principles and concepts of the invention have been set forth above, it is to be understood that such a structure and method of fabrication thereof are not limited by this disclosure. Therefore, while the preferred embodiment of the invention has been disclosed with reference to a specific headgear cushion, it is to be understood that many changes in detail may be made as a matter of engineering choice without departing from the spirit and scope of the invention, as defined by the appended claims.

What is claimed is:

1. A cushion adapted for use in a night vision headgear, comprising:

a closed-cell foam core formed in a shape for fitting into the headgear;

a dark colored vinyl/nitrile coating covering substantially all surfaces of said foam core to form a nonallergenic surface, said dark coloring being effective to reduce light reflections so that said headgear remains secure from detection by other night vision equipment; and a pressure responsive material covering substantially one entire side surface of said foam core and fixed thereto by adhering said material to the vinyl/nitrile coating.

2. The cushion of claim 1 wherein said foam core comprises a density of about 2–6 pounds per cubic foot.

3. The cushion of claim 1 wherein said vinyl/nitrile coating includes a powered carbon to provide said dark coloring.

4. The cushion of claim 1 wherein said foam core is shaped in the form of an inverted "T", whereby a hoizontal part thereof is adapted to provide cushioning about the forehead of the headgear user, and a vertical part thereof is adapted to engage the foremost crown part of the user's head.

5. The cushion of claim 4 wherein the horizontal part of said "T" includes depending extensions for enlarging a temple engaging area thereof.

6. A method for fabricating a cushion for a night vision headgear, comprising the steps of:

stamping a core of cushion material from a foam material sheet;

mixing a color agent in a vinyl/nitrile liquid composition to provide a mixture which is substantially nonreflective to light and nonallergenic;

dip-coating said foam core in the vinyl/nitrile liquid and allowing the coating to cure; and adhering a pressure responsive material to one side surface of said vinyl/nitrile coated foam core.

7. The method of claim 6 further including stamping said core of foam from a sheet of foam having a thickness corresponding to a head size desired to be accommodated by the headgear.

8. The method of claim 7 further including stamping said foam core from a foam material ranging in thickness from $\frac{1}{8}$ inch to $\frac{1}{2}$ inch.

9. The method of claim 6 further including stamping said core from a high density closed-cell material ranging from 2–6 pounds per cubic foot.

10. The method of claim 6 further including stamping said core of closed-cell foam material having a density such that after said coating the surface thereof is smooth.

11. The method of claim 6 further including stamping said core in the shape of an inverted "T".

12. The method of claim 6 further including adhering said pressure responsive material to substantially the entire said one side surface of said coated foam core.

13. The method of claim 6 further including mixing a powdered carbon with said vinyl/nitrile liquid to provide said dark colored surface which is substantially nonreflective to light.

* * * * *